US005779091A

United States Patent [19]

Thomas

[11] Patent Number: 5,779,091

[45] Date of Patent: Jul. 14, 1998

[54] SIXCON ADAPTOR

[75] Inventor: James D. Thomas, Macomb County, Mich.

[73] Assignee: The United States of America as represented by the Secretary of the Army, Washington, D.C.

[21] Appl. No.: 759,824

[22] Filed: Nov. 13, 1996

[51] Int. Cl.[6] ..... B65D 25/00

[52] U.S. Cl. ..... 220/561; 220/1.5; 206/598; 206/599

[58] Field of Search ..... 206/598, 599, 206/386; 220/1.5, 561

[56] References Cited

U.S. PATENT DOCUMENTS

| | | | |
|---|---|---|---|
| 3,797,727 | 3/1974 | Downing et al. | 206/598 |
| 4,267,780 | 5/1981 | Candella | 206/598 |
| 4,380,300 | 4/1983 | Mountz et al. | 206/598 |
| 4,790,249 | 12/1988 | Webb | 206/599 |
| 5,031,776 | 7/1991 | Morgan, IV | 220/1.5 |
| 5,248,051 | 9/1993 | Yurgevich et al. | 206/599 |

*Primary Examiner*—Joseph M. Moy
*Attorney, Agent, or Firm*—David L. Kuhn; Peter A. Taucher

[57] ABSTRACT

An adapter converts for aircraft use a cargo container whose fork lift access tubes pass through the container's frame. The adapter has first blocks at ends of the tubes, and wedge portions of the first blocks face on the tubes' insides. Adapter members affix to the first blocks and extend along the container's base. Second, wedge-like blocks at the tubes' ends face against both the tubes' insides and the first blocks. The second blocks move together to lock the first blocks in place. The mechanism to force the second blocks together includes elongate members in the tubes. One end of each elongate member is threaded and passes through one of the second blocks while the other end of the elongate member connects to another second block. Turning a nut on the elongate member forces the one second block toward the other second block.

18 Claims, 3 Drawing Sheets

SIXCON ADAPTOR

GOVERNMENT USE

The invention described here may be made, used and licensed by or for the U.S. Government for governmental purposes without paying me royalty.

BACKGROUND AND SUMMARY

Modern military logistics requires shipping containers that can be taken off land vehicles and loaded onto military aircraft having standard cargo bay fixtures or hold-downs. However, certain kinds of overland shipping containers, especially open frame SIXCON containers, are not well suited for military aircraft. Such shipping containers require extra man hours for lading and can cause shipping delays.

I have invented a removable adapter that addresses the foregoing problem. My removable adapter converts a SIXCON or like container for stowage in a standard military aircraft cargo bay. My adapter utilizes the container's fork lift access tubes, which pass through the base of the container's frame. The adapter has first blocks at openings of the tubes. The blocks are positioned so that their wedge portions face on the tubes' insides. Flat, crenelated skirts are adapter members which attach to the first blocks and extend along the container's base.

Second, wedge-like blocks at the tubes' openings are pulled toward one another so as to squeeze the first blocks against the tubes' insides. The mechanism to force the second blocks together has elongate members extending through the tubes. A threaded end of each elongate member passes through one of the second blocks; the opposite end of the elongate member connects to another second block. Turning a nut on the threaded end forces the second blocks toward each. The first blocks are jammed in place, thereby fixing the adapter members to the SIXCON container.

DETAILED DESCRIPTION

Figure 1:
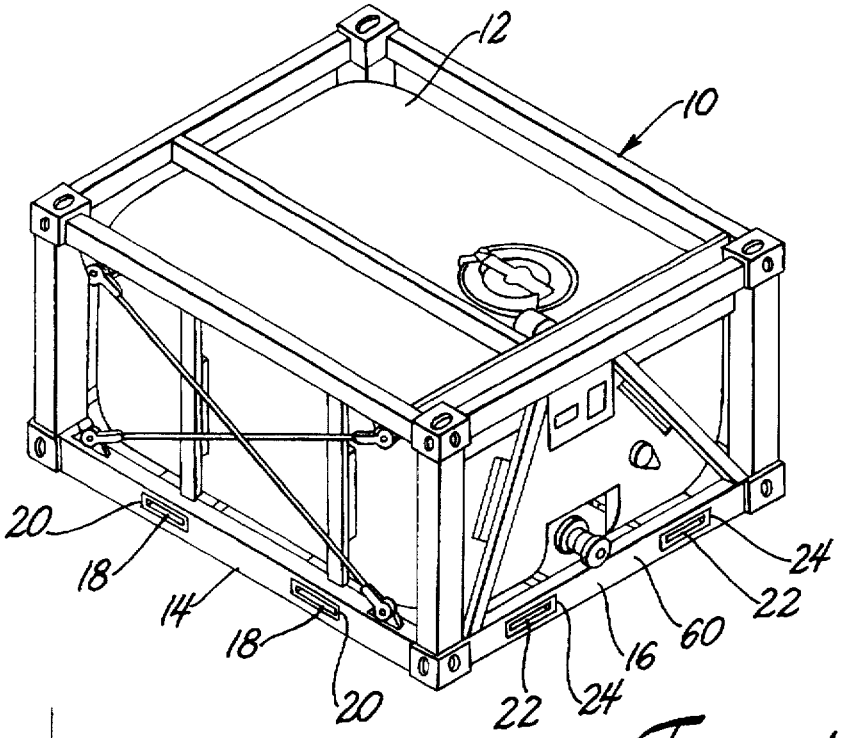
FIG. 1 is a perspective view of a known SIXCON container.
Figure 2:
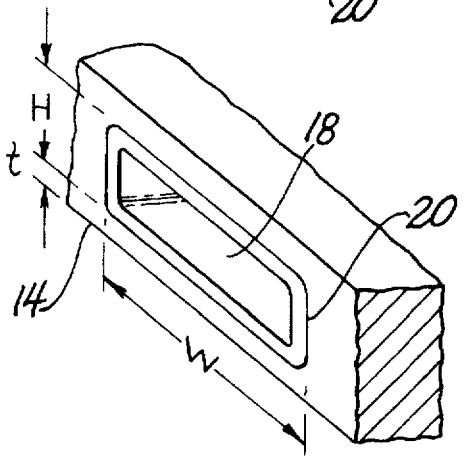
FIG. 2 is a detail view showing the opening of a fork lift access tube at the base of the SIXCON container.

FIG. 1 shows SIXCON unit 10, a conventional open-frame cargo container used in semi-trailers or box cars and typically used for shipping fuel cells such as tank 12. The bottom of unit 10 is a rectangular frame having two parallel longitudinal beams 14 connected to two parallel transverse beams 16. Unit 10 has two sets of tubes which accept the blades of a fork lift: crosswise tubes 18 and lengthwise tubes 22. Crosswise tubes 18 run parallel to beams 16, extend between and through beams 14, and terminate in openings 20 on the exterior of unit 10. Lengthwise tubes 22 run parallel to beams 14, extend between and through transverse beams 16, and terminate in openings 24 at the front and rear of unit 10. As exemplified by opening 22 in FIG. 2, all the openings have a common width W, common height H and are a common distance t from the bottom of beams 14 or 16.

Figure 3:
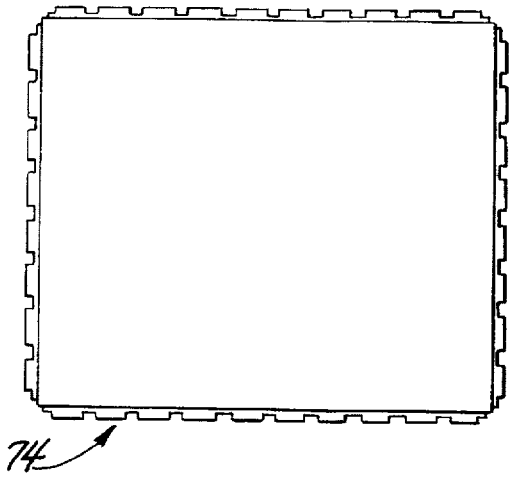
FIG. 3 shows an outline of a cargo pallet used for military air shipments, which outline is achieved by installation of adaptor members on the SIXCON container.
Figure 12:
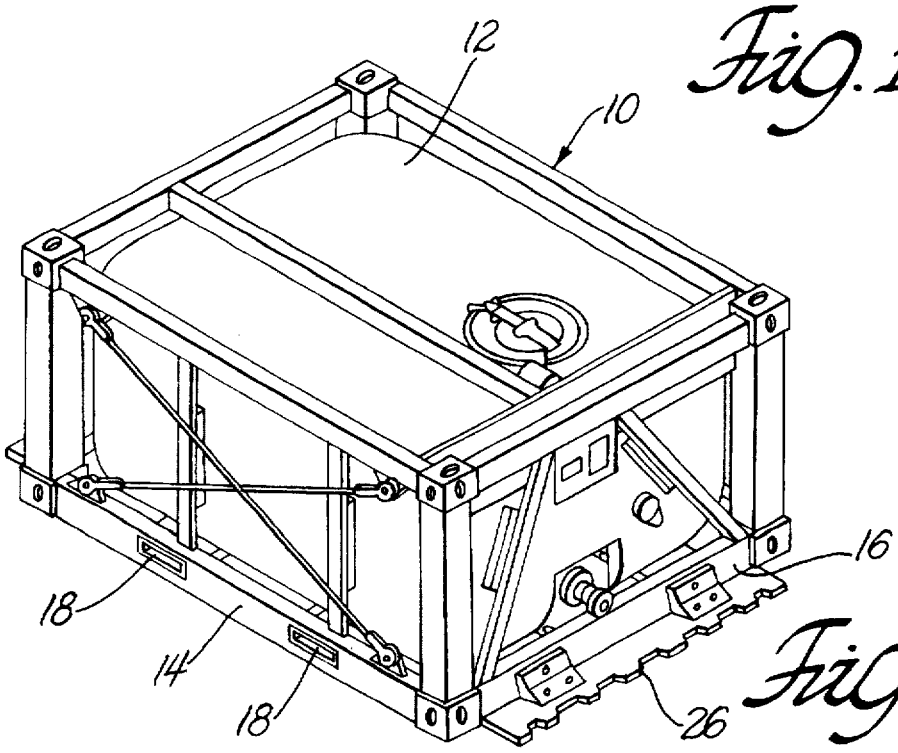
FIG. 12 is a perspective of the SIXCON container with one of the adapter members thereon.

FIG. 12 shows unit 10 as provided with an adaptor member 26 fixed to transverse beam 16. It will be understood that adaptor members 26 can be affixed to both transverse beams 16 and that adaptor members can be affixed to both longitudinal beams 14 as well. When all four adaptor members are installed on unit 10, the base of unit 10 will have the outline 74 shown at FIG. 3, which is the outline of a cargo pallet used for military air shipments. Preferably, when adapter members 26 are attached to unit 10 they are spaced above the surface 54 (FIG. 4) on which unit 10 rests, whereby members 26 do not bear the weight of unit 10.

Figure 4:
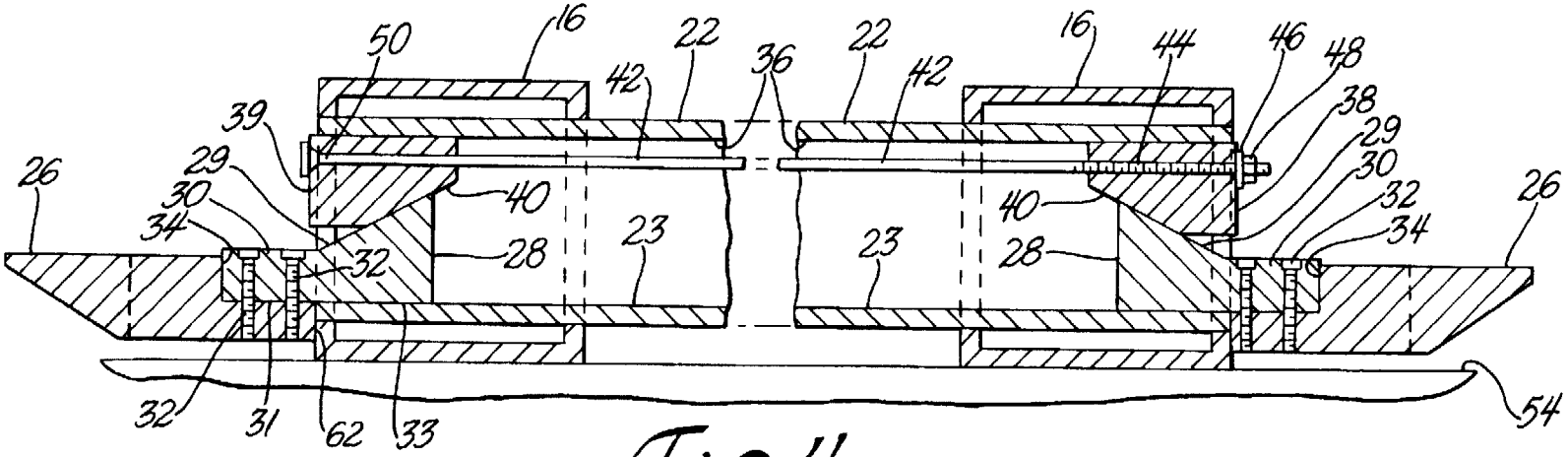
FIG. 4 is a sectioned side elevational view of my adapter installed in a fork lift access tube.

FIG. 4 shows details of construction by which adaptor members 26 are removably attached to unit 10. In that Figure, tube 22 extends between and through transverse beams 16. Disposed partly in tube 22 are wooden blocks 28 lying flat upon the floor surface 23 of tube 22. Blocks 28 have wedge portions 29 that are integrally adjacent to feet 30 which extend out of tube 22. The bottoms 31 of feet 30 are flat and flush with bottom 33 of wedge portion 29. Adaptor members 26 are screwed or bolted to feet 30 by threaded fasteners 32. The feet fit into shallow notches 34 of the adaptor members, one of notches 34 being shown in the FIG. 8 plan view of adaptor 26. Floating wooden blocks 38 and 39 are essentially wedges that fit between the ceiling surface 36 of tube 22 and portions 29 of fixed blocks 28. Floating blocks 38 and 39 have bearing surfaces 40 which are oblique to tube surfaces 23 and 36, surfaces 40 sliding facially upon wedge portions 29.

Figure 7:
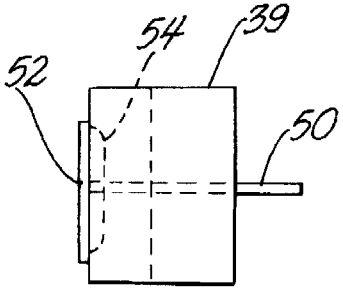
FIG. 7 is a plan elevational view of another second block.
Figure 6:
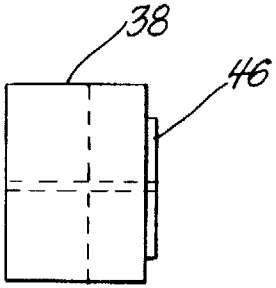
FIG. 6 is a plan elevational view of a second block used to lock first blocks in position in the access tube.
Figure 5:
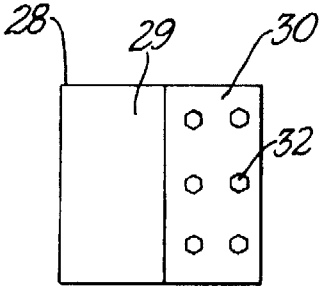
FIG. 5 is a plan elevational view of a first block, by which adapter members are connected to the SIXCON container.

An elongate member such as rod 42 passes through tube 22 and also passes through floating block 38, one end 44 of the rod being threaded. Threaded end 44 passes through plate 46 fixed to the outward facing surface of the blocks 38 and a nut 48 threaded to rod 40 is adjacent plate 46. As seen in FIG. 7, the other end 50 of rod 42 terminates in an anchor plate 52 having an elongate ridge 54 that congruently fits in a complimentary recess in floating block 39. The engagement between ridge 54 and the complimentary recess comprise an anti-rotation mechanism that prevents rod 42 from turning as nut 48 is turned. Rotating nut 48 in the proper direction moves blocks 38 and 39 toward one another until they jam or wedge against blocks 28. Consequently, blocks 28 are fixed in place and are therefore can be deemed as fixed blocks. Removal of nut 48 from rod 42 allows rod 42 and floating block 39 to be removed from tube 22, whereupon floating block 38, and fixed block 28 can also be removed and thereby disassembling adapter members 26 from unit 10.

Figure 9:
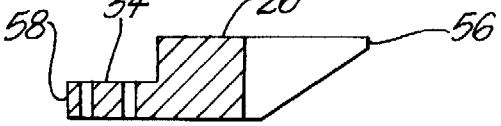
FIG. 9 is a view taken along line 9—9 in FIG. 8.
Figure 10:
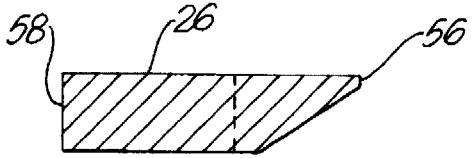
FIG. 10 is a view taken along line 10—10 in FIG. 8.
Figure 8:
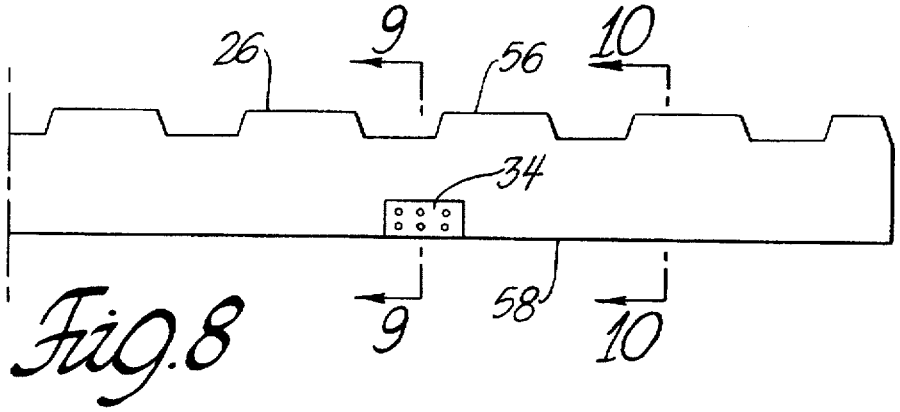
FIG. 8 shows one half of an adapter member for the SIXCON unit.

FIGS. 8, 9 and 10 show details of construction of adapter member 26, which has a flat, skirt-like configuration. In FIG. 8 is shown an outer, crenelated edge 56 that mates to standard fixtures in the cargo bay of transport aircraft. The opposite, inner edge 58 is flat so as to make surface contact with exterior beam surface 60 (FIG. 1) of transverse beam 16 or a like exterior surface of longitudinal beam 14. Such surface contact is exemplified by interfaces 62 (FIG. 4) when adapter members 26 are installed on unit 10 at transverse beams 16.

Figure 11:
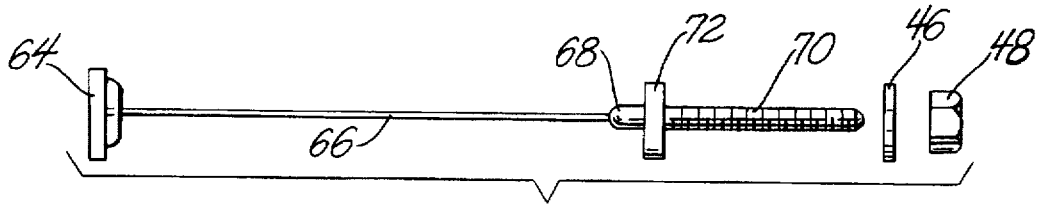
FIG. 11 is an alternate version of a mechanism to pull the second blocks together, the first version being shown in FIG. 4.
Figure 13:
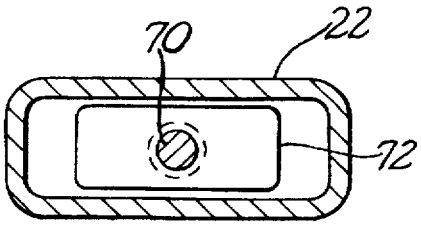
FIG. 13 is a detail view of an anti-rotation mechanism used on the FIG. 11 mechanism.

FIG. 11 shows a block retention member which optionally replaces rod 42 in the FIG. 4 structure. The block retention member includes a flexible tension cable 66 fixed at one end to anchor plate 64, which has the same configuration as anchor plate 52. The other end of cable 66 is fixed to shank 68 of rigid threaded member 70 which passes through floating block 38 and plate 46 in the same manner as does rod end 44. As seen in conjunction with FIG. 13, threaded member 70 includes an anti-rotation mechanism in the form of collar 72, which prevents member 70 from rotating with respect to tube 22. Threading nut 48 onto member 70 pulls floating blocks 38 and 39 together in much the same fashion as would threading nut 48 onto rod 42.

I do not desire to be limited to the exact details of construction or method shown herein since obvious modifications will occur to those skilled in the relevant arts without departing from the spirit and scope of the following claims.

What is claimed is:

1. A structure to adapt a cargo container for one kind of transport vehicle to another kind of transport vehicle, wherein the container has a frame and a tube passing through the frame, the structure comprising:

first blocks at ends of the tube contacting an inner peripheral surface of the tube;

adapter members fixed to the first blocks, the adapter members abutting the container;

second blocks at the ends of the tube and at least partly in the tube;

wherein the second blocks oppose the first blocks;

means for forcing the second blocks toward one another and jamming the second blocks against the first blocks.

2. The structure of claim 1 wherein the forcing means comprises:

an elongate member connected to one of the second blocks and passing through another of the second blocks.

3. The structure of claim 2 wherein the forcing means further comprises:

threads on the elongate member;

an internally threaded member on the elongate member.

4. The structure of claim 3 wherein the forcing means further comprises means to prevent rotation of the elongate member.

5. The structure of claim 1 wherein the adapter members are spaced from a surface on which the cargo container rests.

6. The structure of claim 1 wherein the first blocks are in facial contact with the second blocks.

7. A structure to adapt a cargo container for one kind of transport vehicle to another kind of transport vehicle, wherein the container has a frame and a tube passing through the frame, the structure comprising:

first blocks at either end of the tube;

wedge portions of the first blocks bearing against a first inner peripheral surface of the tube;

feet of the first portions extending at least partly out of the tube;

adapter members fixed to the feet, the adapter members being in surface contact with the container;

second blocks at either end of the tube, the second blocks faced against a second inner peripheral surface of the tube opposing the first inner peripheral surface;

wherein parts of the second blocks oppose the wedge portions;

means for forcing the second blocks toward one another and jamming the second blocks against the first blocks.

8. The structure of claim 7 wherein the forcing means comprises:

an elongate member in the tube;

means at one end of the elongate member for connecting one of the second blocks to the elongate member;

another of the second blocks defining an aperture through which passes the elongate member.

9. The structure of claim 8 wherein the forcing means further comprises:

threads at another end of the elongate member;

an internally threaded member on the elongate member.

10. The structure of claim 9 wherein the forcing means further comprises means to prevent rotation of the elongate member with respect to the tube.

11. The structure of claim 7 wherein the adapter members are spaced from a surface on which the cargo container rests, whereby the adapter members do not bear weight of the cargo container.

12. The structure of claim 11 wherein the first blocks are forced facially against the second blocks.

13. A structure to adapt an open frame cargo container for one kind of transport vehicle to another kind of transport vehicle, wherein the container includes a frame and fork lift access tubes passing through a base of the frame, the structure comprising:

first blocks at either end of the tube;

wedge portions of the first blocks bearing against a first inner peripheral surface of the tube;

feet of the first portions extending at least partly out of the tube;

adapter members fixed to the feet, the adapter members being in surface contact with the container and extending along the base of the container;

second, generally wedge shaped blocks at either end of the tube, the second blocks faced against a second inner peripheral surface of the tube opposing the first inner peripheral surface;

wherein planar surfaces of the second blocks face upon the wedge portions;

means for forcing the second blocks toward one another and jamming the second blocks against the first blocks.

14. The structure of claim 13 wherein the forcing means comprises:

an elongate member in the tube, at least part of the elongate member being rigid;

means at one end of the elongate member for retaining one of the second blocks on the elongate member;

another of the second blocks defining an aperture through which passes the elongate member.

15. The structure of claim 14 wherein the forcing means further comprises:

threads at another end of the elongate member;

an internally threaded member on the threads of the elongate member;

the other second block disposed between the internally threaded member and the one second block.

16. The structure of claim 15 wherein the forcing means further comprises means to prevent rotation of the elongate member with respect to the tube.

17. The structure of claim 13 wherein the adapter members are flat flange-like members running along the base of the container and spaced from a surface on which the cargo container rests.

18. The structure of claim 17 wherein the first blocks are forced by the forcing means facially against the second blocks.

* * * * *